US008677532B2

(12) United States Patent
Legare

(10) Patent No.: US 8,677,532 B2
(45) Date of Patent: Mar. 25, 2014

(54) PORTABLE SUPPORT MAT

(71) Applicant: Exodus Traffic Systems Ltd., Maple Ridge (CA)

(72) Inventor: Desiree Legare, Abbotsford (CA)

(73) Assignee: Exodus Traffic Systems Ltd., Maple Ridge (CA)

( * ) Notice: Subject to any disclaimer, the term of this patent is extended or adjusted under 35 U.S.C. 154(b) by 0 days.

(21) Appl. No.: 13/644,262

(22) Filed: Oct. 4, 2012

(65) Prior Publication Data

US 2013/0269112 A1 Oct. 17, 2013

Related U.S. Application Data

(60) Provisional application No. 61/543,173, filed on Oct. 4, 2011.

(51) Int. Cl.
*A47C 16/00* (2006.01)

(52) U.S. Cl.
USPC ..... 5/652; 5/653; 5/630; 5/656; 5/901; 297/452.45; 248/346.01; 248/346.4

(58) Field of Classification Search
USPC ..... 5/420, 630, 648, 652, 653, 656, 417, 5/703, 736, 944, 901; 297/452.43, 297/452.45; 428/156; 601/28; 182/230; 248/633, 346.01, 346.2, 346.4
See application file for complete search history.

(56) References Cited

U.S. PATENT DOCUMENTS

| | | | | | |
|---|---|---|---|---|---|
| 2,061,664 | A | * | 11/1936 | Lincoln | 5/653 |
| 3,323,151 | A | * | 6/1967 | Lerman | 5/722 |
| 3,434,715 | A | * | 3/1969 | Brantingham et al. | 482/79 |
| 5,402,545 | A | * | 4/1995 | Jolley | 5/653 |
| 5,572,758 | A | * | 11/1996 | Merritt | 5/653 |
| 5,628,079 | A | * | 5/1997 | Kizemchuk et al. | 5/653 |
| 5,802,642 | A | * | 9/1998 | Slaughter | 5/656 |
| 5,863,637 | A | * | 1/1999 | Mannsson et al. | 428/156 |
| D413,985 | S | * | 9/1999 | Martin et al. | D24/211 |
| 6,287,659 | B1 | * | 9/2001 | Robbins et al. | 428/43 |
| 6,589,631 | B1 | * | 7/2003 | Suzuki et al. | 428/172 |
| 6,839,928 | B1 | * | 1/2005 | Woodall et al. | 5/653 |
| 8,220,087 | B2 | * | 7/2012 | Villa et al. | 5/420 |

* cited by examiner

*Primary Examiner* — Michael Trettel
(74) *Attorney, Agent, or Firm* — Island IP Law; Stephen R. Burri

(57) ABSTRACT

A portable, unitary, lightweight, weather-proof support mat to reduce physical stress on a user caused by standing, sitting or kneeling on a hard surface for prolonged periods. The support mat provides a non-slip surface and an integral handle opening. The support mat is manufactured of rubber or other resilient material and may be provided in a variety of shapes and sizes.

16 Claims, 2 Drawing Sheets

PORTABLE SUPPORT MAT

FIELD OF THE INVENTION

The present invention relates to health aids. In particular, the present invention relates to support devices to improve pressure distribution for a user on a rigid surface.

BACKGROUND OF THE INVENTION

Individuals who stand, kneel or sit for prolonged periods may experience health problems arising from the stress of such activity on hard surfaces. It is desirable to reduce the stress of standing, kneeling and sitting by providing a cushioned mat which is suitable for maintaining safety in a hazardous work environment, and easily portable between work or leisure activity sites, and between standing, kneeling or sitting positions within a site.

It is known to provide resilient anti-fatigue mats. It is also known to provide non-slip surfaces. The present invention addresses the need for an easily portable non-slip anti-fatigue mat.

SUMMARY OF THE INVENTION

There is provided a support mat for reducing physical stress during standing, sitting and kneeling, the support mat comprising a planar, resilient platform having upper and lower surfaces, and opposing fore and aft sections, and non-slip means provided on at least a portion of the upper surface.

The support mat may have at least one opening disposed in proximity to the outer perimeter of the support mat to form a handle. The at least one opening may comprise at least two adjacent openings to form a finger hold handle.

The support mat may have non-slip means on at least a portion of the lower surface and a bevelled edge along at least a portion of the circumference of the platform. The non-slip means may be an array of rounded projections, or it may be a tacky coating. The perimeter of the support mat may be rounded.

The support mat may be manufactured of rubber, or a resilient synthetic material.

BRIEF DESCRIPTION OF THE DRAWINGS

A detailed description of the preferred embodiments is provided below by way of example only and with reference to the following drawings, in which.

Figure 1:
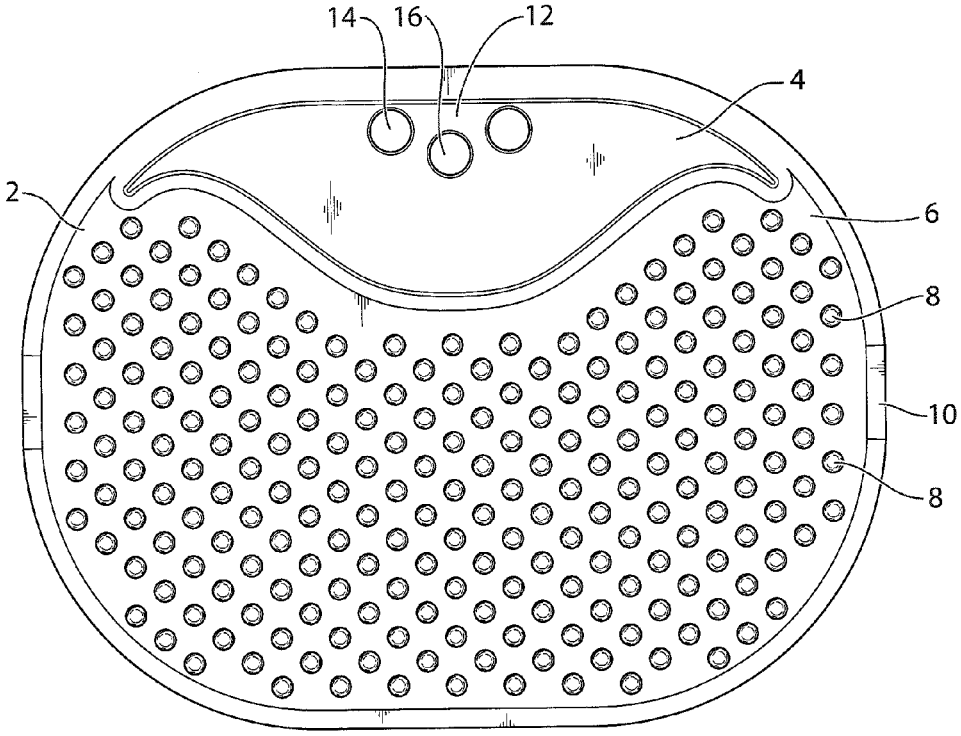
FIG. 1 depicts a top plan view of one embodiment of the mat of the present invention.

In the drawings, one embodiment of the invention is illustrated by way of example. It is to be expressly understood that the description and drawings are only for the purpose of illustration and as an aid to understanding, and are not intended as a definition of the limits of the invention.

DESCRIPTION OF THE INVENTION

Figure 2:
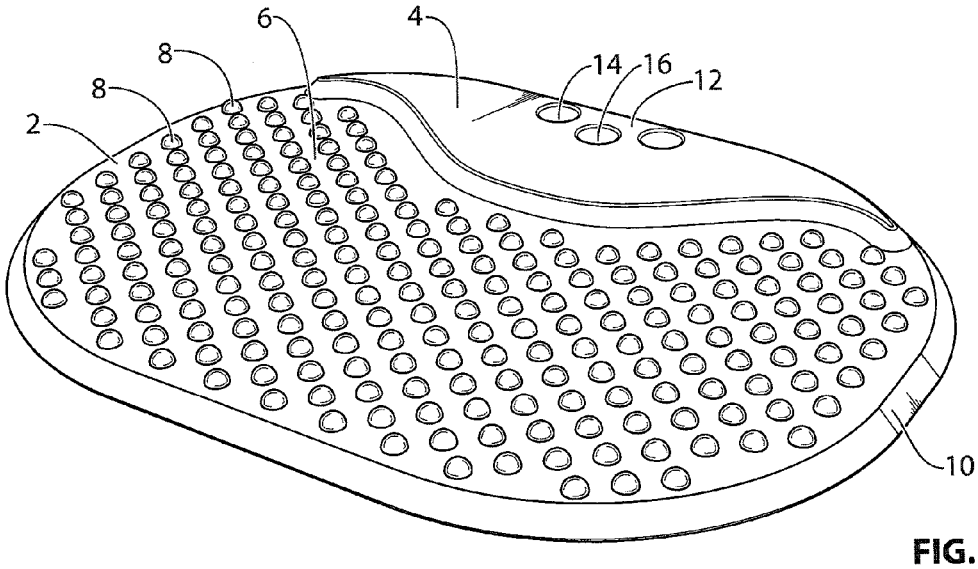
FIG. 2 depicts a perspective view of one embodiment of the mat of the present invention.
Figure 3:
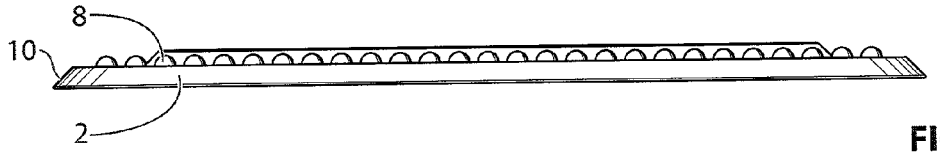
FIG. 3 depicts a side view of the non-slip portion of the mat of the present invention.

As shown in FIGS. 1, 2 and 3, there is provided a lightweight, portable, and durable support mat for use by an individual during any activities requiring standing, kneeling or sitting.

The mat preferably has a horizontal upper surface 2 which is generally ovoid in shape, although other shapes are considered to be within the scope of the invention, including rectangular, square, circular, triangular, and other regular and irregular polygonal shapes. The upper surface preferably comprises a smooth portion 4, and a non-slip portion 6.

Preferably, the mat has a width of between 12 and 24 inches, a length of between 18 and 30 inches, and a thickness of between 0.25 and 2.0 inches. More preferably, the mat has a width of between 16 and 20 inches, a length of between 22 and 26 inches, and a thickness of between 0.5 and 1.0 inches. Ideally, the mat has a width of 18 inches, a length of 23.5 inches, and a thickness of 0.5 inches. Other mat dimensions are also possible and are within the scope of the invention.

In a preferred embodiment, the mat is manufactured of rubber or other resilient material, and a plurality of rounded projections 8, or buttons, are arrayed in a regular pattern throughout at least a portion of the upper surface of the mat. The buttons present on the upper surface provide a non-slip surface to reduce accidents caused by slipping.

In a preferred embodiment, the smooth portion of the upper surface is in proximity to one edge of the mat, and devoid of rounded projections or other non-slip means. A portion of the smooth surface may be used to display branding, safety, or other information.

In a preferred embodiment, at least a portion of the outer edge of the mat may be bevelled for ease of access onto the mat, and comfort if standing with the feet over the edge of the mat. The bevelled edge 10 also facilitates use of the mat to support one part of the foot while leaving the other part on the hard surface, as this offers another standing position which may help reduce stress.

The mat further comprises an integral handle 12. The handle may comprise one or more openings 14 in proximity to one longitudinal edge of the mat through which a user's hand or one or more fingers may be inserted for carrying the mat. In a preferred embodiment, three adjacent openings are provided for insertion of three fingers of a user during carrying, with the central opening 16 offset relative to the outer openings, to correspond to the relative locations of the ends of a user's three central fingers in a carrying position.

Preferably the three openings are circular. In the embodiment shown in FIGS. 1 and 2, openings have a diameter of 3 centimeters, although other sizes are also within the scope of the invention. The one or more openings may also be used to attach a cord or other device for ease of handling, transportation and storage.

As the mat is manufactured of a resilient material, it provides a softer surface on which to stand, sit or kneel for a user. As such, use of the mat will alleviate muscle pain and stiffness by its users who may need to stand, sit or kneel for extended periods on hard surfaces such as asphalt and concrete.

The support mat of the present mat is particularly useful in occupations requiring prolonged standing, for example for traffic control workers, where sitting is not possible during work due to the need to be able to escape from approaching dangers rapidly. A resilient support mat will reduce the stress of prolonged standing, allowing longer work periods and reduced pain and injury. Reduced pain will lead to increased alertness for quick thinking in a high stress situation. The more aware and focused the traffic control person is, the greater the reaction time for events such as a runaway vehicle, approaching machinery, or any other potentially catastrophic event that may occur.

The mat of the present invention will allow the worker to work for several hours without discomfort, whereas without the mat there likely would be irritability and exhaustion. Use of the mat may permit several additional hours of work per week for each user. Use of the mat may also reduce jobsite rotation by workers seeking lower stress, easier work, and will result in greater endurance for the individual worker who has already been orientated to the job at hand, thereby reducing training and supervision requirements.

The support mat is easily moved between job sites, as well as standing positions within a single job site. The mat, weighing only approximately 5 pounds, is very easy to handle and transport. Its design also permits stacking of mats for transportation and storage.

The rubber material of the mat permits its use in any weather, wet or dry, hot or cold. This capacity makes the support mat of the present invention highly suitable for outdoor use.

The rubber bubbled mat creates a non-slip surface that is crucial in outdoor working conditions which may include rain and snow. The surface of the mat has improved traction in wet and snowy conditions, relative to a wet or snowy road surface, thereby reducing risk of slipping and falling. A button mat, due to the presence of non-slip features on its surface, provides a good grip for users who would be wearing required safety footwear in the industry. It also provides maximum comfort to shift workers who generally work long hours; it relieves pain immediately upon use. For those workers who have chronic pain of any kind they would largely benefit from this product.

Other non-slip means may also be provided. For example, a tacky coating may be applied to the mat to increase friction between the support mat surface and a user's feet. Also, the surface may have a series of ridges or a grid to provide non-slip means. In one embodiment, a non-slip surface may be provided on both sides of the mat to increase safety when using the mat on a smooth surface such as a wooden floor.

A further benefit of the use of rubber is to reduce harm due to electrical shock as rubber is non-conducting. This will reduce mortality in electrical accidents. The resulting reduction in injury will be an economic benefit to employers, and will reduce claims for worker injury and death.

A wide variety of occupations may use the support mat of the present invention. These may include traffic control persons, or flaggers, who may use several mats located at various standing positions at a job site; electricians, who would particularly benefit from the shock resistance of the mat, workers in bucket trucks or underground utilities requiring small, portable support mats; and security guards who may stand in several places throughout a shift. Numerous other occupations would also benefit from use of a portable, lightweight, weather-proof support mat.

As well as use in work environments, the support mat may be used in therapy and rehabilitation to reduce stress on injured or stressed muscles and joints, and to reduce pain. It may also be used recreationally, for example during gardening, landscaping, auto repair or other activities requiring standing, sitting, or kneeling on hard surfaces. For example, users may carry the support mat to an outdoor public event such as a concert to allow comfort during prolonged sitting, while avoiding blocking the view of those seated behind them at the event. Whatever use is made of the support mat, it is easily moved from place to place, easily cleaned, and easily stored.

As many possible embodiments may be made of the invention without departing from the scope of the claims, it is to be understood that all matter herein set forth or shown in the accompanying drawings is illustrative and not limiting. It will be appreciated by those skilled in the art that other variations of the preferred embodiment may also be practised without departing from the scope of the invention.

What is claimed is:

1. A portable, unitary support mat for reducing physical stress during standing, sitting and kneeling, the support mat comprising a planar, resilient platform having upper and lower surfaces, opposing fore and aft sections, non-slip means provided on at least a portion of the upper surface, and at least one opening disposed in proximity to the outer perimeter of the platform to form an integral handle, wherein the at least one opening comprises at least two adjacent openings to form a finger hold handle.

2. A portable, unitary support mat for reducing physical stress during standing, sitting and kneeling, the support mat comprising a planar, resilient platform having upper and lower surfaces, opposing fore and aft sections, non-slip means provided on at least a portion of the upper surface, and at least one opening disposed in proximity to the outer perimeter of the platform to form an integral handle, wherein the at least one opening comprises three adjacent openings, the central opening being offset relative to the two outer openings to correspond to the locations of the ends of the fingers of a user in a carrying position.

3. The support mat of claim 2, wherein the upper surface of the platform further comprises a smooth section, and a non-slip section having non-slip means.

4. The support mat of claim 3 wherein the non-slip means of the upper surface comprises an array of rounded projections rising above the platform.

5. The support mat of claim 4, wherein the array of rounded projections completely covers the non-slip section of the upper surface of the platform.

6. The support mat of claim 4, wherein the distance between adjacent rounded projections is greater than the diameter of each rounded projection.

7. The support mat of claim 2 further comprising non-slip means on at least a portion of the lower surface.

8. The support mat of claim 2 further comprising a bevelled edge on at least a portion of the circumference of the platform.

9. The support mat of claim 8, wherein the bevelled edge extends around the entire perimeter of the platform.

10. The support mat of claim 2 wherein the perimeter of the platform is rounded.

11. The support mat of claim 2, wherein the mat is manufactured of rubber.

12. The support mat of claim 2 wherein the mat is manufactured of a resilient synthetic material.

13. The support mat of claim 3 wherein the non-slip surface is a tacky coating.

14. The support mat of claim 2, wherein the platform is between 12 and 24 inches wide, between 18 and 30 inches long, and between 0.25 and 2.0 inches thick.

15. The support mat of claim 14, wherein the platform is between 16 and 20 inches wide, between 20 and 26 inches long, and between 0.5 and 1.0 inches thick.

16. The support mat of claim 15, wherein the platform is 18 inches wide, 23.5 inches long, and 0.5 inches thick.

* * * * *